US010294825B2

(12) United States Patent
Heber et al.

(10) Patent No.: US 10,294,825 B2
(45) Date of Patent: May 21, 2019

(54) WASTE-HEAT UTILIZATION ASSEMBLY OF AN INTERNAL COMBUSTION ENGINE AND METHOD FOR OPERATING A WASTE-HEAT UTILIZATION ASSEMBLY

(71) Applicant: Robert Bosch GmbH, Stuttgart (DE)

(72) Inventors: Frank Heber, Achstetten (DE); Manfred Schmitt, Heppenheim (DE); Mathias Kurras, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 114 days.

(21) Appl. No.: 15/511,236

(22) PCT Filed: Jul. 15, 2015

(86) PCT No.: PCT/EP2015/066159
§ 371 (c)(1),
(2) Date: Mar. 14, 2017

(87) PCT Pub. No.: WO2016/041656
PCT Pub. Date: Mar. 24, 2016

(65) Prior Publication Data

US 2017/0254226 A1 Sep. 7, 2017

(30) Foreign Application Priority Data

Sep. 15, 2014 (DE) ..... 10 2014 218 485

(51) Int. Cl.
*F01K 23/06* (2006.01)
*F01K 13/00* (2006.01)
*F01K 23/10* (2006.01)

(52) U.S. Cl.
CPC ..... *F01K 23/065* (2013.01); *F01K 13/00* (2013.01); *F01K 23/101* (2013.01)

(58) Field of Classification Search
CPC ..... F01K 23/065; F01K 13/00; F01K 23/101
(Continued)

(56) References Cited

U.S. PATENT DOCUMENTS 4,519,207 A 5/1985 Okabe et al.
4,685,309 A * 8/1987 Behr ..... F25B 5/00 251/129.05

(Continued)

FOREIGN PATENT DOCUMENTS

AT 512921 12/2013
DE 10221594 11/2003

(Continued)

OTHER PUBLICATIONS

International Search Report for Application No. PCT/EP2015/066159 dated Oct. 14, 2015 (English Translation, 2 pages).

*Primary Examiner* — Hoang M Nguyen
(74) *Attorney, Agent, or Firm* — Michael Best & Friedrich LLP

(57) ABSTRACT

The invention relates to a waste-heat utilization assembly (1) of an internal combustion engine (50), comprising a circuit (2) that conducts a working medium, wherein a pump (6), a distribution valve block (7), two evaporators (10, 11), an expansion machine (3), and a condenser (4) are arranged in the circuit (2) in the flow direction of the working medium. The two evaporators (10, 11) are arranged in a parallel connection, and the parallel connection begins at the distribution valve block (7) and ends at a node point (8). A temperature sensor (21) for determining the outlet temperature of the working medium at the expansion machine (3) is arranged between the expansion machine (3) and the condenser (4).

24 Claims, 3 Drawing Sheets

(58) Field of Classification Search
USPC ..... 60/646, 657, 660–667, 676
See application file for complete search history.

(56) References Cited

U.S. PATENT DOCUMENTS

| | | | | |
|---|---|---|---|---|
| 5,755,104 | A * | 5/1998 | Rafalovich | F25B 13/00 62/205 |
| 2003/0213246 | A1* | 11/2003 | Coll | F01K 17/02 60/653 |
| 2009/0151356 | A1 | 6/2009 | Ast et al. | |
| 2010/0281913 | A1* | 11/2010 | Birkelund | F25B 39/028 62/498 |
| 2011/0203278 | A1 | 8/2011 | Kopecek et al. | |
| 2012/0042650 | A1 | 2/2012 | Ernst et al. | |

FOREIGN PATENT DOCUMENTS

| | | | |
|---|---|---|---|
| DE | 102010033124 | A1 | 2/2012 |
| WO | 2014124139 | A1 | 8/2014 |

* cited by examiner

WASTE-HEAT UTILIZATION ASSEMBLY OF AN INTERNAL COMBUSTION ENGINE AND METHOD FOR OPERATING A WASTE-HEAT UTILIZATION ASSEMBLY

BACKGROUND OF THE INVENTION

The invention relates to a waste-heat utilization arrangement of an internal combustion engine, and to a method for operating the waste-heat utilization arrangement, wherein, according to the invention, sensors for determining temperatures and pressures of the working medium are arranged within the circuit of the waste-heat utilization arrangement, and the temperatures and pressures thus determined are used for the regulation and/or control of the throughflow of the working medium through the circuit.

Waste-heat utilization arrangements of internal combustion engines are known from the prior art, for example from the patent AT 512 921 B1. The known waste-heat utilization arrangement comprises a circuit which conducts a working medium, wherein a pump, a distributor valve block, two evaporators, an expansion machine and a condenser are arranged in the circuit in the flow direction of the working medium. The two evaporators are arranged in a parallel circuit, and the parallel circuit begins at the distributor valve block and ends at a junction upstream of the expansion machine.

The known waste-heat utilization arrangement operates most effectively in the presence of constant operating conditions of the internal combustion engine. However, if the internal combustion engine is operated with operating conditions that change relatively quickly over time, the expansion machine must be operated with a relatively high average outlet temperature of the working medium in order to avoid condensing of the working medium in the expansion machine at critical operating points of the internal combustion engine.

SUMMARY OF THE INVENTION

By contrast to this, the waste-heat utilization arrangement according to the invention of an internal combustion engine has the advantage that it can be operated optimally under any operating conditions of the internal combustion engine, without at the same time being exposed to the risk of condensation of the working medium in the expansion machine.

For this purpose, the waste-heat utilization arrangement comprises a circuit which conducts a working medium, wherein a pump, a distributor valve block, at least two evaporators, an expansion machine and a condenser are arranged in the circuit in a flow direction of the working medium. The at least two evaporators are arranged in a parallel circuit, and the parallel circuit begins at the distributor valve block and ends at a junction. A temperature sensor for determining the outlet temperature of the working medium from the expansion machine is arranged between the expansion machine and the condenser.

In this way, the outlet temperature of the working medium from the expansion machine can be determined, which constitutes an important variable for optimization in terms of energy, that is to say for optimization of the degree of utilization of the waste-heat utilization arrangement. A temperature difference in relation to the condensation temperature of the working medium can thus be monitored and optimized. Thus, at the same time, an undershooting of the condensation temperature within the expansion machine is prevented, which results in a considerable increase of the service life of the expansion machine and thus of the waste-heat utilization arrangement as a whole. Depending on the design of the exhaust system of the internal combustion engine, it is also the case in advantageous embodiments that more than two evaporators are provided.

In an advantageous refinement of the invention, a pressure sensor for determination of the inlet pressure of the working medium into the expansion machine is installed between the junction and the expansion machine. In this way, the distributor valve block can be especially optimally actuated for distributing the mass flow of the working medium between the two evaporators in order to further improve the efficiency of the waste-heat utilization arrangement.

It is advantageously the case that a collecting vessel is arranged between the condenser and the pump, and a further pressure sensor for determining the inlet pressure of the working medium into the pump is installed between the collecting vessel and the pump. In this way, the actuation of the pump and/or of the distributor valve block can be further optimized with regard to the increase in efficiency of the waste-heat utilization arrangement. Furthermore, the inlet pressure of the working medium into the pump can be used as an early indicator for the inlet pressure of the working medium into the expansion machine, whereby faster regulation of precisely said inlet pressure into the expansion machine is possible.

Below, methods for operating a waste-heat utilization arrangement of an internal combustion engine will be described which realize an optimization of the efficiency of the waste-heat utilization arrangement and/or an increase in power of the waste-heat utilization arrangement and at the same time prevent condensing of the working medium in the expansion machine.

For this purpose, the method comprises a circuit which conducts a working medium, wherein a pump, at least one evaporator, an expansion machine and a condenser are arranged in the circuit in a flow direction of the working medium. An outlet temperature from the expansion machine is determined between the expansion machine and the condenser. The method is characterized in that a control unit regulates the pump as a function of the outlet temperature from the expansion machine such that the outlet temperature lies above the condensation temperature of the working medium only by an optimized temperature difference, wherein the optimized temperature difference is less than 25 K, preferably less than 5 K.

In this way, the efficiency of the waste-heat utilization arrangement is optimized, because, in the condenser, only the relatively low optimized temperature difference has to be eliminated by cooling. At the same time, through the monitoring of the outlet temperature by means of the control unit, condensing of the working medium in the expansion machine is prevented, and thus the service life of the expansion machine—and thus also of the waste-heat utilization arrangement as a whole—is increased.

In an advantageous refinement of the method according to the invention, the control unit increases the mass flow of the working medium through the pump if the outlet temperature of the working medium from the expansion machine is higher than the sum of the condensation temperature and the optimized temperature difference. Also, the control unit reduces the mass flow of the working medium through the pump if the outlet temperature from the expansion machine is lower than the sum of the condensation temperature and the optimized temperature difference.

In this way, in a simple manner, the mass flow of the working medium through the at least one evaporator is increased if the outlet temperature of the working medium from the expansion machine is relatively high, that is to say if the at least one evaporator were capable of evaporating even more working medium to a required inlet temperature into the expansion machine. On the other hand, the mass flow through the at least one evaporator is reduced if the outlet temperature of the expanded working medium from the expansion machine becomes too low, and thus the inlet temperature of the pressurized working medium into the expansion machine also becomes too low. If this were not the case, then in the event of a further drop in the inlet temperature—or of the inlet pressure—condensation of the working medium would occur in the expansion machine, which would result in a high level of wear in the expansion machine, for example to the impeller of the expansion machine if the expansion machine is a turbine.

In an advantageous refinement, for different operating states of the waste-heat utilization arrangement, the optimized temperature difference is stored in a characteristic map as a function of the exhaust-gas state variables of the internal combustion engine, specifically at least one exhaust-gas temperature and at least one exhaust-gas mass flow or one exhaust-gas volume flow. Subsequently, during the operation of the waste-heat utilization arrangement, the respective operating state of the waste-heat utilization arrangement is determined and the optimized temperature difference is regulated to the values stored in the characteristic map for the respectively determined operating state. Here, it must be ensured that, in the case of multiple evaporators being used, an associated exhaust-gas temperature and an associated exhaust-gas mass flow and/or an associated exhaust-gas volume flow are stored in the characteristic map for each evaporator, these values then being implemented in the operating state.

It is thus possible for the exhaust-gas state variables of exhaust-gas temperature, exhaust-gas mass flow or exhaust-gas volume flow to be stored in a characteristic map for all of the evaporators used in the waste-heat utilization arrangement. During operation, said characteristic map is then implemented, and the optimized temperature difference is regulated to a value which is stored in said characteristic map for the respective operating state.

Where reference is made below to an exhaust-gas mass flow, it is also always possible for an exhaust-gas volume flow to be used in place thereof.

It is advantageously the case that, for the method according to the invention, the optimized temperature difference is calculated as a function of the two exhaust-gas state variables of exhaust-gas temperature and exhaust-gas mass flow:

- in the presence of increasing exhaust-gas temperature, the optimized temperature difference is reduced,
- in the presence of increasing exhaust-gas mass flow, the optimized temperature difference is reduced,
- in the presence of falling exhaust-gas temperature, the optimized temperature difference is increased, and
- in the presence of falling exhaust-gas mass flow, the optimized temperature difference is increased.

In this way, the state variables of exhaust-gas temperature and exhaust-gas mass flow, which are fundamental in describing the thermal energy that can be provided to the at least one evaporator, are taken into consideration for the calculation of an optimized outlet temperature of the expanded working medium from the expansion machine. The efficiency of the waste-heat utilization arrangement or the power of the waste-heat utilization arrangement and the robustness with respect to condensation of the working medium in the expansion machine are thereby further increased.

In an advantageous refinement of the method according to the invention, in the waste-heat utilization arrangement, at least two evaporators are arranged in a parallel circuit between a distributor valve block and a junction. An inlet pressure of the working medium into the expansion machine is determined between the junction and the expansion machine. The distributor valve block divides the mass flow of the working medium between the at least two evaporators, wherein the control unit controls the distributor valve block as a function of the inlet pressure of the working medium into the expansion machine, such that the inlet pressure is maximized.

As a result of the maximization of the inlet pressure of the evaporated working medium into the expansion machine, the power of the expansion machine and thus of the waste-heat utilization arrangement as a whole is increased because—based on particle considerations—with increasing pressure, the impetus of the working medium on the impeller of the expansion machine or on the piston of the expansion machine likewise increases. Through the maximization of the inlet pressure of the working medium into the expansion machine, it is furthermore the case that, in the presence of an unchanging inlet temperature, the risk of condensation of the working medium in the expansion machine is minimized.

As an alternative to the inlet pressure of the evaporated working medium into the expansion machine, it is also possible here for the pressure upstream of the two evaporators or the inlet temperature into the expansion machine to be used. This has the advantage that sensors of lower cost can be used, whereas a relatively expensive high-temperature-resistant sensor must be used for the direct measurement of the inlet pressure.

For the corresponding regulation regimes, it is necessary here to take into consideration different characteristics of the variables to be regulated:

- The inlet pressure into the expansion machine exhibits a PT1 characteristic.
- The inlet pressure into the two evaporators exhibits a PT1 characteristic.
- The inlet temperature into the expansion machine exhibits a PT2 characteristic.

The control unit advantageously controls the distributor valve block and regulates the distribution of the mass flow of the working medium between the at least two evaporators by way of extreme-value regulation. By way of the extreme-value regulation, it is possible in a relatively straightforward manner to realize an optimum division of the mass flow of the working medium between the at least two evaporators. Here, an excitation signal is generated which corresponds to a relatively small change in the division of the mass flow in the distributor valve block. The change in the inlet pressure of the evaporated working medium into the expansion machine is evaluated as a response signal, with the aim of maximizing said inlet pressure. The control unit correspondingly evaluates how the response signal behaves in relation to the excitation signal, that is to say whether said response signal is in phase or out of phase.

The regulation of the outlet temperature of the working medium from the expansion machine is advantageously performed more quickly in terms of time than the regulation of the inlet pressure of the working medium into the expansion machine. In this way, it is ensured that the main regulator, specifically the regulator for the outlet temperature, has priority over the secondary regulator, the regulator for the inlet pressure. Thus, regulation of the variable of outlet temperature, which is of primary importance for the efficiency and in particular for the service life of the waste-heat utilization arrangement, is performed first, and regulation of the inlet pressure is performed only thereafter.

In an advantageous alternative embodiment, a multi-variable regulator is used which optimally regulates the outlet temperature of the working medium from the expansion machine and the inlet pressure of the working medium into the expansion machine simultaneously. In this way, very fast regulation of said two variables is realized.

In an advantageous refinement of the method according to the invention, an inlet temperature of the evaporated working medium into the expansion machine is determined upstream of the expansion machine. The control unit calculates an expander efficiency using the difference between the inlet temperature and the outlet temperature of the working medium into and out of the expansion machine. The control unit controls and regulates the mass flow of the working medium through the pump and/or through the distributor valve block as a function of the expander efficiency.

As a result of the expander efficiency being taken into consideration in the actuation of pump and/or distributor valve block, the efficiency of the waste-heat utilization arrangement as a whole is further optimized. The aim of the actuation of pump and/or distributor valve block is in this case to maximize the difference between inlet temperature and outlet temperature; here, it is however self-evidently necessary for the outlet temperature to always be higher than the condensation temperature of the working medium by the optimized temperature difference.

In an advantageous refinement of the method according to the invention, an expander rotational speed or an expander torque is determined at an output shaft of the expansion machine, wherein the control unit regulates the pump and/or the distributor valve block by way of extreme-value regulation as a function of the expander rotational speed or as a function of the expander torque. In alternative embodiments, it is additionally also possible for the expander efficiency to be used as a regulation variable for said regulation.

Through the determination of the expander rotational speed and/or of the expander torque, one or two variables is or are determined which can be used for the determination of the power output by the expansion machine. Through the actuation of the pump and/or of the distributor valve block as a function of the power of the expansion machine, said power can be maximized as a fundamental target variable. Here, it should be noted that the expander torque can be taken into consideration directly for determining the power, and the expander rotational speed can be taken into consideration only indirectly, because the expander rotational speed on its own does not contain any information regarding the load acting on the output shaft.

In another advantageous refinement of the method according to the invention, an expander rotational speed is determined at an output shaft of the expansion machine. The control unit varies the mass flow of the working medium through the pump and/or through the distributor valve block by means of an excitation signal with a fixed frequency. The control unit then filters said frequency out of the expander rotational speed using a bandpass filter, and evaluates the phase position in relation to the excitation signal. The control unit thus calculates a changed actuation signal for the pump and/or for the distributor valve block.

In this way, for the expander rotational speed, extreme-value regulation can be performed with the aim of maximizing the expander rotational speed. The excitation signal, either the change in the mass flow of the working medium through the pump or the change in the division of the mass flow by means of the distributor valve block, is then evaluated with regard to the response signal, specifically the change in the expander rotational speed. The bandpass filter makes it possible for the control unit to filter disturbance variables—such as for example changing loads acting on the output shaft—out of the response signal. The actuation of pump and/or distributor valve block as a function of the expander rotational speed is thus made more robust with respect to the disturbance variables.

In an advantageous embodiment of the method according to the invention, in each case one exhaust-gas temperature and one exhaust-gas mass flow are stored in a characteristic map for each operating state and for each evaporator of the waste-heat utilization arrangement. During the operation of the waste-heat utilization arrangement, the respective operating state of the waste-heat utilization arrangement is determined. The control unit calculates a component of the actuation of the pump and/or of the distributor valve block in a manner dependent on said characteristic map, and correspondingly controls and regulates the pump and/or the distributor valve block in a manner dependent on said calculation. In this way, the most optimum possible exhaust-gas mass flow or exhaust-gas volume flow can be supplied to each evaporator for every operating state.

In advantageous embodiments, the actuation of pump and/or distributor valve block is performed as follows:

- in the presence of increasing exhaust-gas temperature at an evaporator, the mass flow of the working medium to said evaporator is increased,
- in the presence of increasing exhaust-gas mass flow at an evaporator, the mass flow of the working medium to said evaporator is increased,
- in the presence of falling exhaust-gas temperature at an evaporator, the mass flow of the working medium to said evaporator is reduced, and
- in the presence of falling exhaust-gas mass flow at an evaporator, the mass flow of the working medium to said evaporator is reduced.

The abovementioned mechanisms of action are to be regarded in each case as one of several components of the actuations of pump and/or distributor valve block. That is to say, in the case of combinations of multiple variables—for example exhaust-gas temperature and exhaust-gas mass flow—the individual mechanisms of action are implemented cumulatively. In this way, a situation may for example also arise in which the mass flow of the working medium is reduced even though the exhaust-gas temperature increases, specifically because the exhaust-gas mass flow has decreased at the same time.

With this refinement, by means of the two exhaust-gas state variables of exhaust-gas temperature and exhaust-gas mass flow, the operating point of the internal combustion engine is taken into consideration for the control of the waste-heat utilization arrangement. The regulation of the two target variables of outlet temperature of the working medium from the expansion machine and inlet pressure of the working medium into the expansion machine is thereby performed more quickly. Furthermore, it is thus also possible for the expected future operating point of the internal combustion engine to be taken into consideration for the actuation of pump and/or distributor valve block. This is for example conceivable if an altitude profile of a route planner for a motor vehicle with an internal combustion engine and an associated waste-heat utilization arrangement according to the invention is available.

In an advantageous refinement, a collecting vessel is arranged in the waste-heat utilization arrangement between the condenser and the pump. An inlet temperature and an inlet pressure of the working medium into the pump are determined between the collecting vessel and the pump. For different operating states of the waste-heat utilization arrangement, a cavitation threshold is determined as a function of the inlet temperature and the inlet pressure and is stored in a characteristic map. During the operation of the waste-heat utilization arrangement, the control unit, as a function of the inlet temperature and the inlet pressure of the working medium into the pump, regulates said two variables such that cavitation in the pump is prevented. For example, this may be achieved in that, when the cavitation threshold is approached, the inlet temperature of the working medium into the pump is reduced by virtue of the mass flow of the working medium through the pump being increased. A further possibility for preventing cavitation in the pump is to increase the inlet pressure of the working medium into the pump.

Through the prevention of cavitation in the pump, the service life of the pump and thus also of the waste-heat utilization arrangement as a whole is considerably increased.

In an advantageous refinement of the method, with decreasing inlet temperature, the throughflow of the working medium through the pump is also reduced. Correspondingly, with increasing inlet temperature, the throughflow of the working medium through the pump is increased.

This method takes into consideration the inlet temperature of the working medium into the pump and thus indirectly also into the two evaporators; alternatively, it is self-evidently also possible for the two inlet temperatures of the working medium into the two evaporators to be determined. The inlet temperature of a mass flow of the working medium into an evaporator must overshoot a certain threshold temperature if, for a given exhaust-gas mass flow and given exhaust-gas temperature through said evaporator, it is sought to achieve a minimum temperature of the working medium downstream of the evaporator, which ultimately corresponds to a minimum temperature of the working medium upstream of the expansion machine. Thus, the inlet temperature of the working medium into the pump is also a form of early indicator for the outlet temperature of the working medium from the expansion machine, and can thus advantageously be used for the actuation of the pump. The regulation of the outlet temperature of the working medium from the expansion machine is thus performed even more quickly in terms of time.

DETAILED DESCRIPTION

Figure 1:
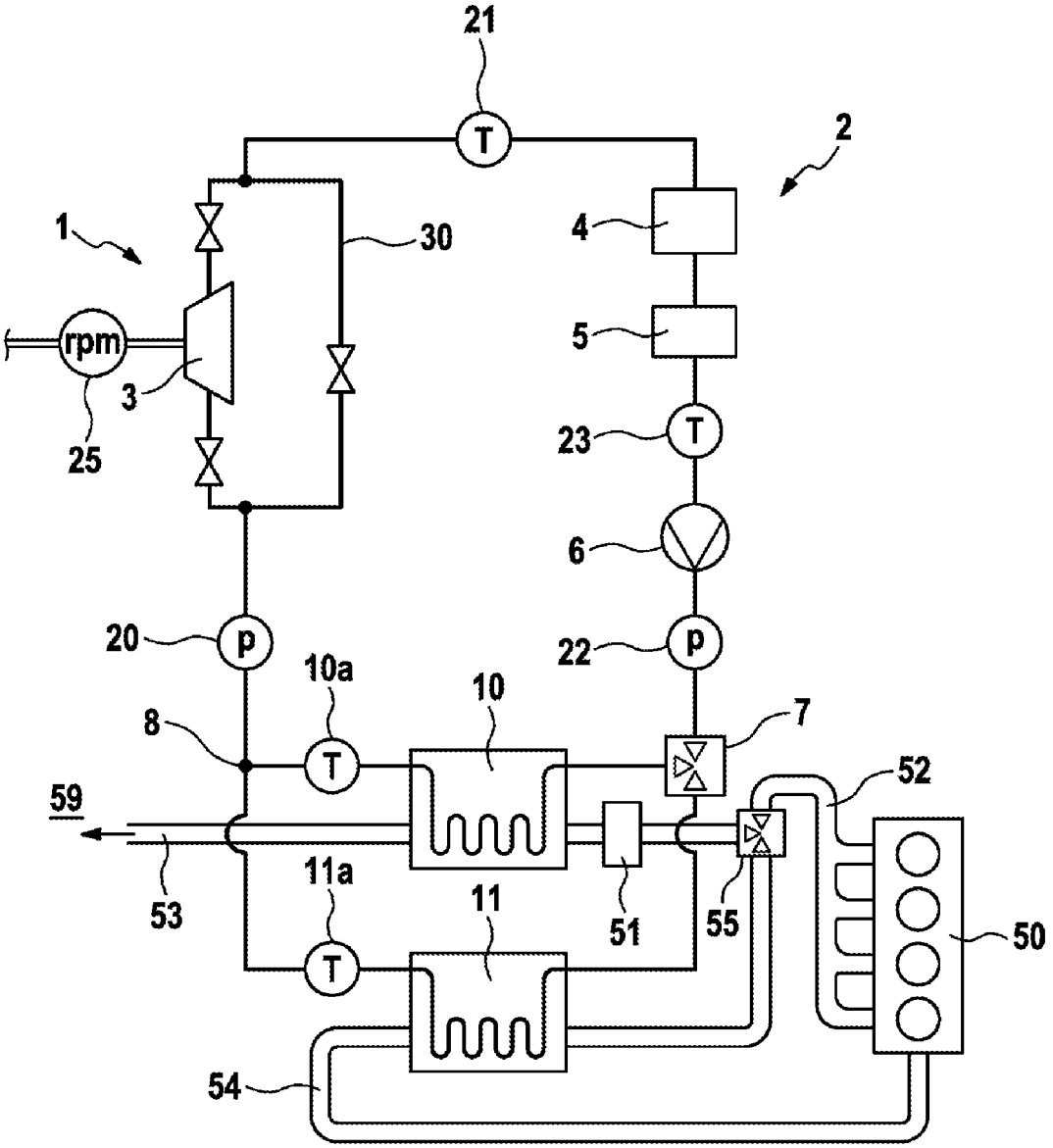
FIG. 1 schematically shows a waste-heat utilization arrangement according to the invention of an internal combustion engine.

FIG. 1 schematically shows a waste-heat utilization arrangement 1 according to the invention of an internal combustion engine 50 having a circuit 2 which conducts a working medium.

The internal combustion engine 50 has, at its outlet, an exhaust-gas tract 52 through which the exhaust gas is discharged from the internal combustion engine. The exhaust-gas tract 52 branches, at an exhaust-gas distributor valve 55, into an exhaust-gas duct 53 and a recirculation duct 54. In the exhaust-gas duct 53 there are arranged one or more exhaust-gas aftertreatment systems 51, such as for example particle filters, and the exhaust gas is, after flowing through the exhaust-gas duct 53, released into the surroundings 59. The recirculation duct 54 opens into the internal combustion engine 50 again, such that, for the combustion process, exhaust gas is mixed with fresh air; the aim here is that of minimizing the nitrogen emissions of the internal combustion engine 50.

The exhaust-gas distributor valve 55 controls the distribution of the mass flow of the exhaust gas into the exhaust-gas duct 53 and into the recirculation duct 54. It is normally the case that a significant fraction of the exhaust gas is conducted into the recirculation duct 54 predominantly in the part-load range of the internal combustion engine 50, whereas virtually no exhaust gas is conducted into the recirculation duct 54 in the full-load range.

The waste-heat utilization arrangement 1 of the internal combustion engine 50 uses thermal energy from the exhaust gas of the internal combustion engine 50 by virtue of the fact that, in at least one evaporator 10, 11 which is arranged in the circuit 2, the exhaust gas releases thermal energy to the working medium of the circuit 2. In the exemplary embodiment illustrated in FIG. 1, a first evaporator 10 is arranged in the exhaust-gas duct 53 and a second evaporator 11 is arranged in the recirculation duct 54. In alternative embodiments, it is also possible for further evaporators or only a single evaporator to be provided.

A collecting vessel 5, a pump 6, the at least one evaporator 10, 11, an expansion machine 3 and a condenser 4 are arranged in the circuit 2 in the flow direction of the working medium. In embodiments with a parallel arrangement of multiple evaporators 10, 11 in the circuit 2, a distributor valve block 7 is arranged upstream of the evaporators 10, 11; in these embodiments, the working medium is merged again at a junction 8 downstream of the evaporators 10, 11. Unless described otherwise, it will hereinafter always be assumed that two evaporators 10, 11 are arranged in a parallel circuit in the line circuit 2, as illustrated in FIG. 1.

In parallel with respect to the expansion machine 3 there is arranged a bypass duct 30 via which, by means of valve arrangements, the working medium can be conducted past the expansion machine 3, for example if the temperature of the working medium upstream of the expansion machine 3 is too low. The bypass duct 30 may in this case also run through the housing of the expansion machine for the purposes of preheating the expansion machine 3.

According to the invention, multiple sensors for determining temperatures and pressures of the working medium are arranged at various locations in the circuit 2:

- A temperature sensor 21 between the expansion machine 3 and the condenser 4 for the purposes of determining the outlet temperature $T_{21}$ of the working medium from the expansion machine 3.
- A pressure sensor 20 between the junction 8 and the expansion machine 3 for the purposes of determining the inlet pressure $p_{20}$ of the working medium into the expansion machine 3.
- A further temperature sensor 23 between the collecting vessel 5 and the pump 6 for the purposes of determining the inlet temperature $T_{23}$ of the working medium into the pump 6.

A further pressure sensor 22 between the pump 6 and the distributor valve block 7 for the purposes of determining the outlet pressure $p_{22}$ of the working medium from the pump 6.

Two additional temperature sensors 10*a*, 11*a* for the purposes of determining the two outlet temperatures $T_{10a}$, $T_{11a}$ of the working medium from the two evaporators 10, 11. Here, the first additional temperature sensor 10*a* is installed between the first evaporator 10 and the junction 8, and the second additional temperature sensor 11*a* is installed between the second evaporator 11 and the junction 8.

A rotational speed sensor and/or a torque sensor at an output shaft of the expansion machine 3 for the purposes of determining the rotational speed of the expansion machine, hereinafter referred to as expander rotational speed $rpm_{25}$, and/or for determining the torque of the expansion machine, hereinafter referred to as expander torque.

According to the invention, it is not imperatively necessary for all of the sensors to be arranged as illustrated in FIG. 1. In alternative embodiments, it is even possible to dispense with sensors, or for the sensors to be arranged differently, because the pressures and temperatures to be determined may also be determined using substitute variables. In particular, the pressure sensor 20 upstream of the expansion machine 3 is subject to high loads, and must function reliably even in the presence of the high temperatures of the evaporated working medium. It is thus alternatively possible for alternative pressure sensors to be positioned upstream of the evaporators 10, 11, which pressure sensors are exposed only to relatively low temperatures. From the pressures thus determined upstream of the evaporators 10, 11, it is then also possible to calculate an inlet pressure of the evaporated working medium into the expansion machine. Alternatively, it is even possible for the inlet pressure into the expansion machine 3 to be calculated from an inlet temperature of the evaporated working medium into the expansion machine 3.

The rotational speed sensor and/or torque sensor at the output shaft of the expansion machine 3 is required only if the pump 6 and/or the distributor valve block 7 is to be controlled as a function of the expander rotational speed $rpm_{25}$ and/or as a function of the expander torque.

Furthermore, it is self-evidently also possible for sensors to be used which acquire multiple variables (for example pressure and temperature) simultaneously.

Figure 2:
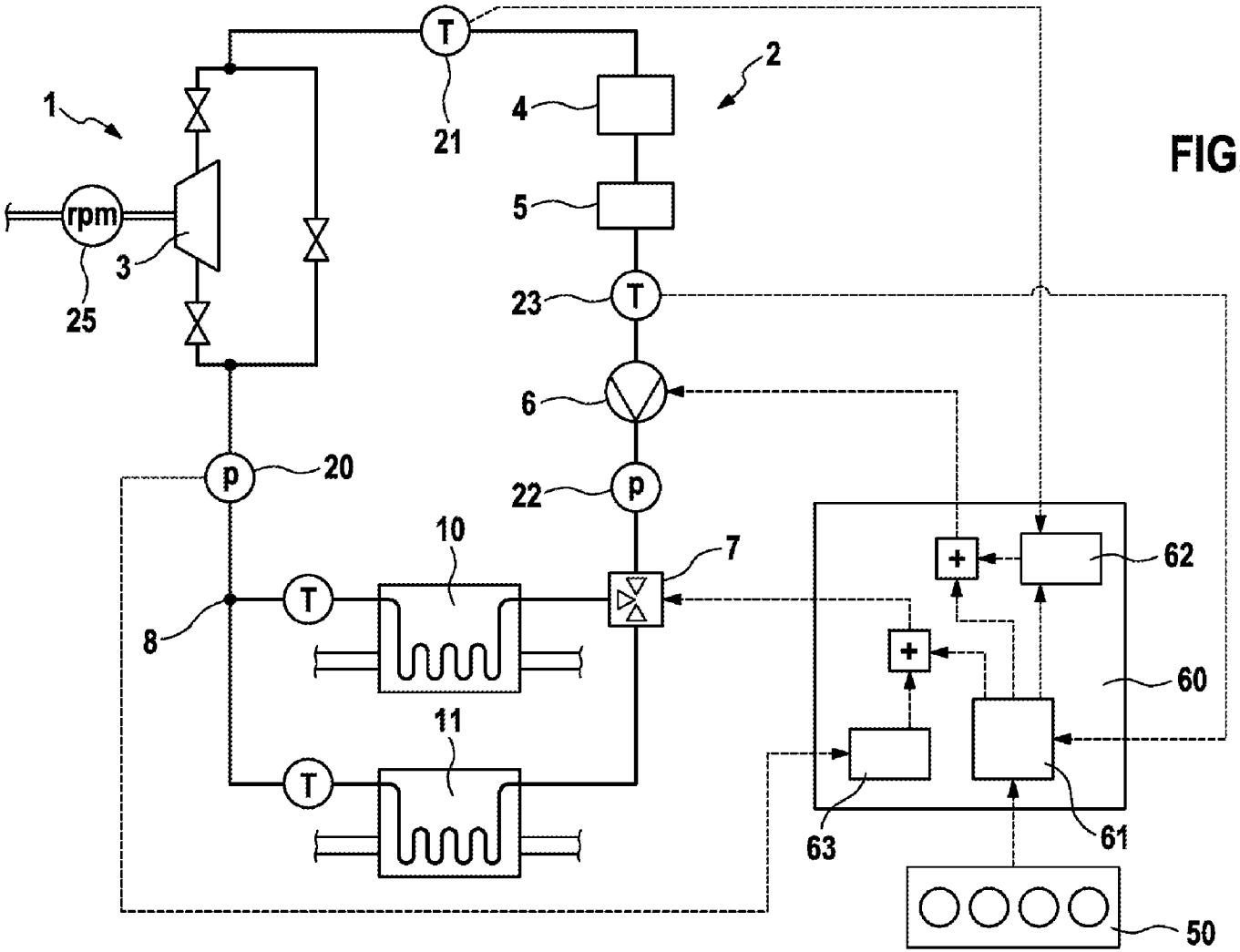
FIG. 2 schematically shows the regulation of the waste-heat utilization arrangement according to the invention of an internal combustion engine, as has been shown in FIG. 1.

FIG. 2 shows a regulation diagram of the waste-heat utilization arrangement according to the invention of an internal combustion engine, as has been described in FIG. 1. FIG. 2 shows the arrangement of a control unit 60 for the acquisition and processing of the data provided by the sensors arranged in the waste-heat utilization arrangement 1. The exemplary embodiment of FIG. 2 is in this case initially restricted to the data acquired by the pressure sensor 20, by the temperature sensor 21 and by the further temperature sensor 23, and to data transmitted from the internal combustion engine 50 to the control unit 60.

For the division of the various regulation regimes and control regimes, the control unit 60 is divided into a controller 61, a fluid mass flow regulator 62 and a fluid mass flow distribution regulator 63, wherein this division relates only to the software but not to the hardware of the control unit 60. Here, the fluid mass flow regulator 62 is the main regulator, and the fluid mass flow distribution regulator 63 is the secondary regulator.

The control unit 60, more specifically the fluid mass flow regulator 62, acquires the outlet temperature $T_{21}$ of the working medium from the expansion machine 3, compares the outlet temperature $T_{21}$ with a setpoint temperature predefined by the controller 61, and thus calculates a setting value for the actuation of the pump 6. The setpoint temperature may in this case be dependent on other variables within the waste-heat utilization arrangement 1 or else on variables of the internal combustion engine 50.

It is the aim of the regulation to achieve that the outlet temperature $T_{21}$ is higher than the condensation temperature $T_K$ of the working medium only by an optimized temperature difference $\Delta T$. The optimized temperature difference $\Delta T$, and thus also the setpoint temperature for the outlet temperature $T_{21}$, may vary as a function of various data, for example of the operating point of the internal combustion engine 50, of expected future operating points of the internal combustion engine 50 and of temperatures and pressures of the working medium at various locations in the waste-heat utilization arrangement 1. In typical operating states of the waste-heat utilization arrangement 1, the optimized temperature difference $\Delta T$ is less than 25 K, preferably less than 5 K.

The control unit 60 regulates the mass flow of the working medium through the pump 6 as a function of the outlet temperature $T_{21}$ of the working medium from the expansion machine 3 as follows:

If the outlet temperature $T_{21}$ is higher than the sum of the condensation temperature $T_K$ and the optimized temperature difference $\Delta T$, the mass flow of the working medium through the pump 6 is increased.

If the outlet temperature $T_{21}$ is lower than the sum of the condensation temperature $T_K$ and the optimized temperature difference $\Delta T$, the mass flow of the working medium through the pump 6 is reduced.

If the outlet temperature $T_{21}$ is equal to the sum of the condensation temperature $T_K$ and the optimized temperature difference $\Delta T$, the mass flow of the working medium through the pump 6 is not changed.

In the regulation regimes, it should be noted that the optimized temperature difference $\Delta T$ may be not only a specific value but also a temperature range. For this case, the temperature range would advantageously encompass at most a temperature interval of 10° C., because otherwise the regulation of the pump 6 would no longer be optimized.

The regulation of the mass flow of the working medium through the pump 6 may also be performed taking into consideration the two exhaust-gas state variables of the internal combustion engine 50 of exhaust-gas temperature and exhaust-gas mass flow, specifically by virtue of the optimized temperature difference $\Delta T$ being varied as a function of said two variables, as follows:

In the presence of increasing exhaust-gas temperature, the optimized temperature difference $\Delta T$ is reduced.

In the presence of increasing exhaust-gas mass flow, the optimized temperature difference $\Delta T$ is reduced.

In the presence of falling exhaust-gas temperature, the optimized temperature difference $\Delta T$ is increased.

In the presence of falling exhaust-gas mass flow, the optimized temperature difference $\Delta T$ is increased.

The change in the optimized temperature difference $\Delta T$ leads to a change in the setpoint value for the outlet temperature $T_{21}$, and thus the fluid mass flow regulator 62 also changes the setting value for the mass flow of the working medium through the pump 6. Normally, for this purpose, the rotational speed and thus the delivery rate of the pump 6 are changed.

Furthermore, the regulation of the mass flow of the working medium through the pump 6 may also be performed taking into consideration the inlet temperature $T_{23}$ of the working medium into the pump 6, as described below:

In the presence of increasing inlet temperature $T_{23}$, the throughflow of the working medium through the pump 6 is increased.

In the presence of falling inlet temperature $T_{23}$, the throughflow of the working medium through the pump 6 is reduced.

Here, it is clear to a person skilled in the art that combinations of the above-described regulation regimes and actuation regimes for the pump 6 may be used.

It is the object of the fluid mass flow distribution regulator 63, that is to say of the secondary regulator, to actuate the distributor valve block 7, and thus divide the mass flow of the working medium between the two evaporators 10, 11, such that the inlet pressure $p_{20}$ of the working medium into the expansion machine 3 is maximized. For this purpose, the pressure sensor 20 determines the inlet pressure $p_{20}$ where possible upstream of the expansion machine 3, alternatively also upstream of the two evaporators 10, 11, and transmits this to the control unit 60, more specifically to the fluid mass flow distribution regulator 63.

The actuation of the distributor valve block 7 by means of the control unit is, for this purpose, preferably performed by way of extreme-value regulation. That is to say, the distributor valve block 7 changes the distribution of the mass flow of the working medium between the two evaporators 10, 11 to a small extent and then compares said change with a subsequent change in the inlet pressure $p_{20}$:

If the inlet pressure $p_{20}$ increases as a result of this measure, the distributor valve block 7 continues the change in the distribution of the mass flow in the same way. The target variable of the inlet pressure $p_{20}$ is then in phase with the excitation signal.

By contrast, if the inlet pressure $p_{20}$ decreases as a result of this measure, then the distributor valve block 7 changes the distribution of the mass flow in the opposite direction. The target variable of inlet pressure $p_{20}$ was then initially out of phase with the excitation signal, and was thereupon brought into phase with the excitation signal by way of a phase shift of the latter.

Example: the distributor valve block 7 changes the distribution of the mass flow such that the mass flow through the first evaporator 10 is increased and that through the second evaporator 11 is reduced. If the inlet pressure $p_{20}$ is reduced as a result, that is to say if the target variable of the inlet pressure $p_{20}$ is out of phase with the change in the distribution of the mass flow, then the actuation of the distributor valve block 7 is changed in the opposite direction, that is to say a phase shift is effected; that is to say, the mass flow through the first evaporator 10 is reduced and the mass flow through the second evaporator 11 is increased, such that the target variable of inlet pressure $p_{20}$ is increased, that is to say is in phase with the change in the distribution of the mass flow. This is continued until the inlet pressure $p_{20}$ decreases again, that is to say a new phase shift occurs. The maximum inlet pressure $p_{20}$ has then been reached.

In further advanced regulation regimes, it is also possible for the change in the distribution of the mass flow through the distributor valve block 7 to be performed as a function of the operating point of the internal combustion engine 50. For example, at full load of the internal combustion engine 50, the second evaporator 54 arranged in the recirculation duct 54 is flowed through with only relatively little exhaust gas, such that, at the start of the full-load state, the distributor valve block 7 can also be actuated such that the mass flow of the working medium into the second evaporator 11 is reduced and, accordingly, the mass flow into the first evaporator 10 is increased.

The regulation diagram provides that the outlet temperature $T_{21}$ of the working medium from the expansion machine 3 is regulated more quickly in terms of time than the inlet pressure $p_{20}$ of the working medium into the expansion machine 3. That is to say: it is primarily the case that the fluid mass flow regulator 62, that is to say the main regulator, actuates the pump 6, and it is secondarily the case that the fluid mass flow distribution regulator 63, that is to say the secondary regulator, actuates the distributor valve block 7.

Figure 3:
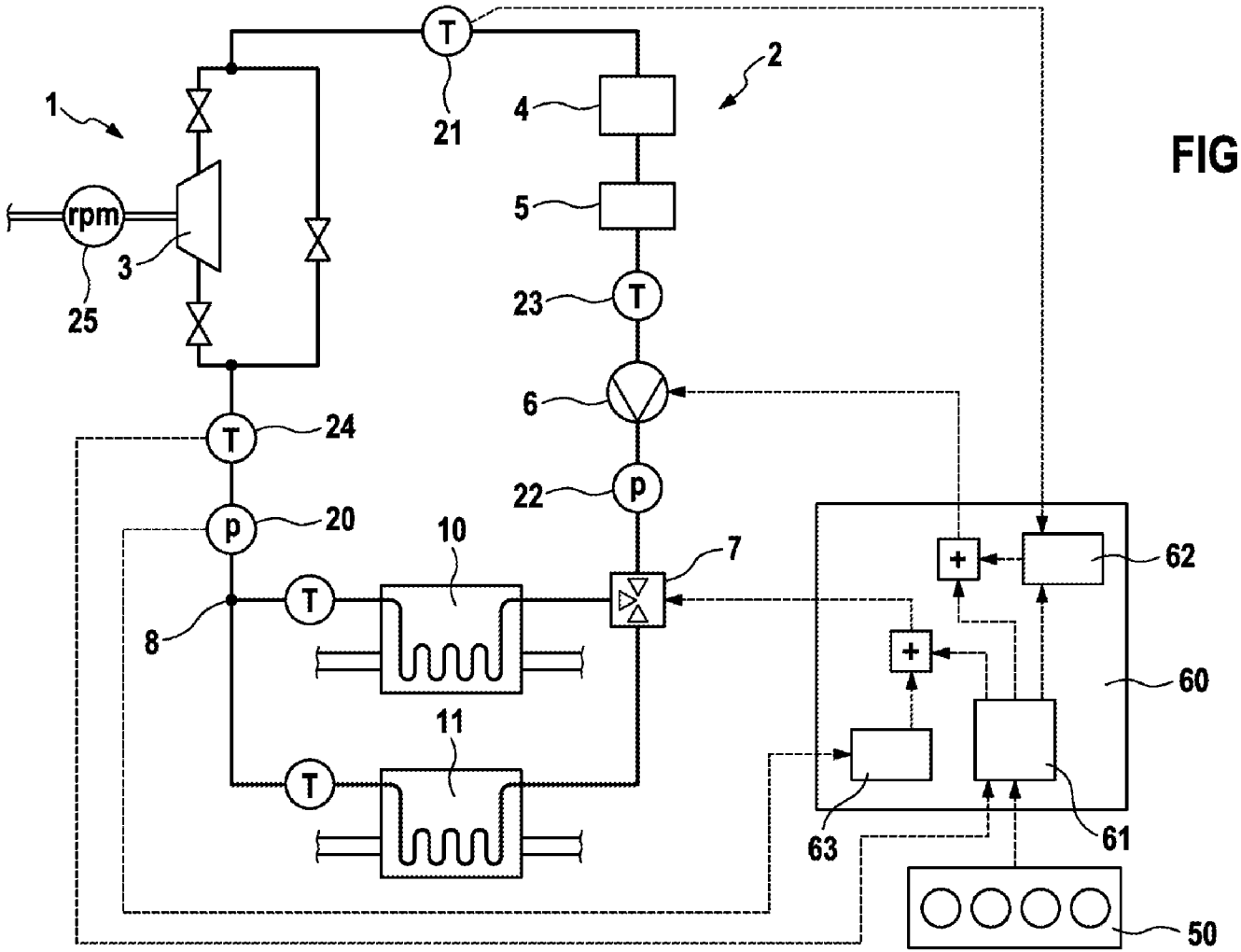
FIG. 3 schematically shows an exemplary embodiment of the waste-heat utilization arrangement according to the invention of an internal combustion engine with an associated regulation diagram.

FIG. 3 schematically shows an exemplary embodiment of the waste-heat utilization arrangement according to the invention of an internal combustion engine with an associated regulation diagram. The only difference in relation to the waste-heat utilization arrangement of FIG. 1 and FIG. 2 is in this case that an additional temperature sensor 24 is arranged between the junction 8 and the expansion machine 3 for the purposes of determining the inlet temperature $T_{24}$ of the working medium into the expansion machine 3. The control unit 60 can thus calculate an expander efficiency using the difference between the inlet temperature $T_{24}$ and the outlet temperature $T_{21}$ of the working medium into and out of the expansion machine 3 respectively. The mass flow of the working medium through the pump 6 and/or the distributor valve block 7 is controlled as a function of the expander efficiency. For example, in the presence of low expander efficiency, the mass flow through the pump 6 is reduced, and in the presence of high expander efficiency, the mass flow through the pump 6 is increased. The actuation of the distributor valve block 7 is advantageously performed taking into consideration the operating point of the internal combustion engine 50. For example, at full load of the internal combustion engine 50 and in the presence of a low expander efficiency, the distributor valve block 7 is actuated such that almost the entire mass flow of the working medium is conducted through the first evaporator 10 arranged in the exhaust-gas duct 53, and almost no mass flow is conducted through the second evaporator 11.

As a further advancement of the regulation diagram discussed immediately above taking into consideration the expander efficiency, the expander rotational speed $rpm_{25}$ and/or the expander torque are/is determined, and the regulation and/or control algorithms for the pump 6 and the distributor valve block 7 are expanded to include these variables. In this case, too, use may be made of the principle of extreme-value regulation as already discussed above, with the aim of maximizing a combination of expander rotational speed $rpm_{25}$ and expander efficiency or maximizing a combination of expander torque and expander efficiency.

For the extreme-value regulation regimes described above, it is advantageously possible for a bandpass filter to be used in order to filter out any disturbance variables from the target variable to be evaluated. Here, the excitation signal, for example a small change in the actuation of the distributor valve block 7 such that the distribution of the working medium between the first evaporator 10 and the second evaporator 11 is changed slightly, is provided with a fixed frequency. Said fixed frequency can be filtered out of the response signal, for example the change in rotational speed of the output shaft of the expansion machine. In this way, disturbance variables, for example other loads on the output shaft, are filtered out, and it can be checked whether the response signal is in phase with the excitation signal or out of phase with the excitation signal.

In further optimized embodiments of the software for the control unit 60, state variables of the exhaust gas of the internal combustion engine 50, for example exhaust-gas temperature and exhaust-gas mass flow, are also taken into consideration for the generation of an excitation signal. For example, in the event of an increase of the exhaust-gas temperature, it is also possible for the throughflow of the working medium through the pump 6, as an excitation signal for the extreme-value regulation, to be increased, because it can be assumed that a response signal—e.g. the expander efficiency—is in phase with the excitation signal.

It is likewise possible for expected state variables, for example impending travel under full load based on the route planner, to be incorporated into the software for the control unit 60.

For various variables to be regulated, for example the optimized temperature difference ΔT, the inlet pressure $p_{20}$ of the working medium into the expansion machine 3 or the inlet temperature $T_{23}$ of the working medium into the pump 6, it is possible for characteristic maps to be established in advance. In these characteristic maps, there are stored values, optimized for particular operating states of the waste-heat utilization arrangement 1, for the variables to be regulated. The operating states are characterized by various other state variables, for example the two exhaust-gas state variables of the internal combustion engine 50 of exhaust-gas temperature and exhaust-gas mass flow, or the rotational speed of the internal combustion engine. During the operation of the waste-heat utilization arrangement 1, the operating state is determined on the basis of said state variables and, correspondingly, an optimum value for the variables to be regulated is read out. By means of regulation algorithms, the variable to be regulated is subsequently set to said optimum value.

The invention claimed is:

1. A method for operating a waste-heat utilization arrangement (1) of an internal combustion engine (50) having a circuit (2) which conducts a working medium, wherein a pump (6), at least one evaporator (10, 11), an expansion machine (3) and a condenser (4) are arranged in the circuit (2) in a flow direction of the working medium, wherein an outlet temperature ($T_{21}$) from the expansion machine (3) is determined between the expansion machine (3) and the condenser (4), wherein a control unit (60) regulates the pump (6) as a function of the outlet temperature ($T_{21}$) from the expansion machine (3) such that the outlet temperature ($T_{21}$) lies above the condensation temperature ($T_K$) of the working medium only by an optimized temperature difference (ΔT), wherein the optimized temperature difference (ΔT) is less than 25 K, wherein the at least two evaporators (10, 11) are arranged in a parallel circuit between a distributor valve block (7) and a junction (8), characterized in that an inlet pressure ($p_{20}$) of the working medium into the expansion machine (3) is determined between the junction (8) and the expansion machine (3), wherein the distributor valve block (7) divides the mass flow of the working medium between the at least two evaporators (10, 11), and wherein the control unit (60) controls and regulates the distributor valve block (7) as a function of the inlet pressure ($p_{20}$) of the working medium into the expansion machine (3), such that the inlet pressure ($p_{20}$) is maximized.

2. The method as claimed in claim 1, characterized in that the control unit (60) increases the mass flow of the working medium through the pump (6) if the outlet temperature ($T_{21}$) from the expansion machine (3) is higher than the sum of the condensation temperature ($T_K$) and the optimized temperature difference (ΔT), and in that the control unit (60) reduces the mass flow of the working medium through the pump (6) if the outlet temperature ($T_{21}$) from the expansion machine (3) is lower than the sum of the condensation temperature ($T_K$) and the optimized temperature difference (ΔT).

3. The method as claimed in claim 1, characterized in that, for different operating states of the waste-heat utilization arrangement (1), the optimized temperature difference (ΔT) is stored in a characteristic map as a function of the exhaust-gas state variables of the internal combustion engine (50), specifically at least one exhaust-gas temperature and at least one exhaust-gas mass flow or at least one exhaust-gas volume flow, and in that, during the operation of the waste-heat utilization arrangement (1), the respective operating state of the waste-heat utilization arrangement (1) is determined and the optimized temperature difference (ΔT) is regulated to the values stored in the characteristic map for the respectively determined operating state.

4. The method as claimed in claim 1, wherein at least two evaporators (10, 11) are arranged in a parallel circuit between a distributor valve block (7) and a junction (8), characterized in that an inlet temperature of the working medium into the expansion machine (3) is determined between the at least two evaporators (10, 11) and the expansion machine (3), wherein the distributor valve block (7) divides the mass flow of the working medium between the at least two evaporators (10, 11), and wherein the control unit (60) controls and regulates the distributor valve block (7) as a function of the inlet temperature of the working medium into the expansion machine (3), such that the inlet temperature is maximized.

5. The method as claimed in claim 1, characterized in that the inlet pressure ($p_{20}$) of the working medium into the expansion machine (3) is determined by virtue of the pressure upstream of the at least two evaporators (10, 11), or an inlet temperature of the working medium into the expansion machine (3), being used as a substitute variable.

6. The method as claimed in claim 1, characterized in that the control unit (60) actuates the distributor valve block (7) and regulates the distribution of the mass flow of the working medium to the at least two evaporators (10, 11) by way of extreme-value regulation.

7. The method as claimed in claim 1, characterized in that the regulation of the outlet temperature ($T_{21}$) of the working medium from the expansion machine (3) is performed more quickly in terms of time than the regulation of the inlet pressure ($p_{20}$) of the working medium into the expansion machine (3), or in that a multi-variable regulator is used which optimally regulates the outlet temperature ($T_{21}$) of the working medium from the expansion machine (3) and the inlet pressure ($p_{20}$) of the working medium into the expansion machine (3) simultaneously.

8. The method as claimed in claim 1, characterized in that an inlet temperature ($T_{24}$) of the working medium into the expansion machine (3) is determined upstream of the expansion machine (3), wherein the control unit (60) calculates an expander efficiency using the difference between the inlet temperature ($T_{24}$) and the outlet temperature ($T_{21}$) of the working medium into and out of the expansion machine (3) and controls and regulates the mass flow of the working medium through the pump (6) and/or the distributor valve block (7) as a function of the expander efficiency.

9. The method as claimed in claim 1, characterized in that an expander rotational speed ($rpm_{25}$) or an expander torque is determined at an output shaft of the expansion machine (3), wherein the control unit (60) regulates the pump (6) and/or the distributor valve block (7) by way of extreme-value regulation as a function of the expander rotational speed ($rpm_{25}$) or as a function of the expander torque.

10. The method as claimed in claim 1, characterized in that an expander rotational speed ($rpm_{25}$) is determined at an output shaft of the expansion machine (3), and in that the control unit (60) varies the mass flow of the working medium through the pump (6) and/or through the distributor valve block (7) by means of an excitation signal with a fixed frequency, filters said frequency out of the expander rotational speed ($rpm_{25}$) using a bandpass filter, and evaluates the phase position in relation to the excitation signal, and thus calculates a changed actuation signal for the pump (6) and/or the distributor valve block (7).

11. The method as claimed in claim 1, characterized in that an exhaust-gas temperature and an exhaust-gas mass flow and/or exhaust-gas volume flow is stored in a characteristic map for different operating states for each evaporator (10, 11), and in that, during the operation of the waste-heat utilization arrangement (1), the respective operating state of the waste-heat utilization arrangement (1) is determined, and the control unit (60) calculates a component of the actuation of the pump (6) and/or of the distributor valve block (7) in a manner dependent on said characteristic map and controls and regulates the pump (6) and/or the distributor valve block (7) in a manner dependent on said calculation.

12. The method as claimed in claim 1, wherein a collecting vessel (5) is arranged between the condenser (4) and the pump (6), and an inlet temperature ($T_{23}$) and an inlet pressure ($p_{23}$) of the working medium into the pump (6) are determined between the collecting vessel (5) and the pump (6), wherein, for different operating states of the waste-heat utilization arrangement (1), a cavitation threshold is stored in a characteristic map as a function of the inlet temperature ($T_{23}$) and the inlet pressure ($p_{23}$), and in that, during the operation of the waste-heat utilization arrangement (1), when the cavitation threshold is approached, the inlet temperature ($T_{23}$) and/or the inlet pressure ($p_{23}$) are regulated such that cavitation in the pump (6) is prevented.

13. The method as claimed in claim 1, wherein the optimized temperature difference ($\Delta T$) is less than 5 K.

14. A method for operating a waste-heat utilization arrangement (1) of an internal combustion engine (50) having a circuit (2) which conducts a working medium, wherein a pump (6), at least one evaporator (10, 11), an expansion machine (3) and a condenser (4) are arranged in the circuit (2) in a flow direction of the working medium, wherein an outlet temperature ($T_{21}$) from the expansion machine (3) is determined between the expansion machine (3) and the condenser (4), wherein a control unit (60) regulates the pump (6) as a function of the outlet temperature ($T_{21}$) from the expansion machine (3) such that the outlet temperature ($T_{21}$) lies above the condensation temperature ($T_K$) of the working medium only by an optimized temperature difference ($\Delta T$), wherein the optimized temperature difference ($\Delta T$) is less than 25 K, wherein the at least two evaporators (10, 11) are arranged in a parallel circuit between a distributor valve block (7) and a junction (8), characterized in that an inlet pressure ($p_{22}$) of the working medium into the at least two evaporators (10, 11) is determined between the pump (6) and the at least two evaporators (10, 11), wherein the distributor valve block (7) divides the mass flow of the working medium between the at least two evaporators (10, 11), and wherein the control unit (60) controls and regulates the distributor valve block (7) as a function of the inlet pressure ($p_{22}$) of the working medium into the at least two evaporators (10, 11) such that the inlet pressure ($p_{22}$) is maximized.

15. The method as claimed in claim 14, characterized in that the control unit (60) increases the mass flow of the working medium through the pump (6) if the outlet temperature ($T_{21}$) from the expansion machine (3) is higher than the sum of the condensation temperature ($T_K$) and the optimized temperature difference ($\Delta T$), and in that the control unit (60) reduces the mass flow of the working medium through the pump (6) if the outlet temperature ($T_{21}$) from the expansion machine (3) is lower than the sum of the condensation temperature ($T_K$) and the optimized temperature difference ($\Delta T$).

16. The method as claimed in claim 14, characterized in that, for different operating states of the waste-heat utilization arrangement (1), the optimized temperature difference ($\Delta T$) is stored in a characteristic map as a function of the exhaust-gas state variables of the internal combustion engine (50), specifically at least one exhaust-gas temperature and at least one exhaust-gas mass flow or at least one exhaust-gas volume flow, and in that, during the operation of the waste-heat utilization arrangement (1), the respective operating state of the waste-heat utilization arrangement (1) is determined and the optimized temperature difference ($\Delta T$) is regulated to the values stored in the characteristic map for the respectively determined operating state.

17. The method as claimed in claim 14, wherein at least two evaporators (10, 11) are arranged in a parallel circuit between a distributor valve block (7) and a junction (8), characterized in that an inlet temperature of the working medium into the expansion machine (3) is determined between the at least two evaporators (10, 11) and the expansion machine (3), wherein the distributor valve block (7) divides the mass flow of the working medium between the at least two evaporators (10, 11), and wherein the control unit (60) controls and regulates the distributor valve block (7) as a function of the inlet temperature of the working medium into the expansion machine (3), such that the inlet temperature is maximized.

18. The method as claimed in claim 14, characterized in that the control unit (60) actuates the distributor valve block (7) and regulates the distribution of the mass flow of the working medium to the at least two evaporators (10, 11) by way of extreme-value regulation.

19. The method as claimed in claim 14, characterized in that an inlet temperature ($T_{24}$) of the working medium into the expansion machine (3) is determined upstream of the expansion machine (3), wherein the control unit (60) calculates an expander efficiency using the difference between the inlet temperature ($T_{24}$) and the outlet temperature ($T_{21}$) of the working medium into and out of the expansion machine (3) and controls and regulates the mass flow of the working medium through the pump (6) and/or the distributor valve block (7) as a function of the expander efficiency.

20. The method as claimed in claim 14, characterized in that an expander rotational speed ($rpm_{25}$) or an expander torque is determined at an output shaft of the expansion machine (3), wherein the control unit (60) regulates the pump (6) and/or the distributor valve block (7) by way of extreme-value regulation as a function of the expander rotational speed ($rpm_{25}$) or as a function of the expander torque.

21. The method as claimed in claim 14, characterized in that an expander rotational speed ($rpm_{25}$) is determined at an output shaft of the expansion machine (3), and in that the control unit (60) varies the mass flow of the working medium through the pump (6) and/or through the distributor valve block (7) by means of an excitation signal with a fixed frequency, filters said frequency out of the expander rotational speed ($rpm_{25}$) using a bandpass filter, and evaluates the phase position in relation to the excitation signal, and thus calculates a changed actuation signal for the pump (6) and/or the distributor valve block (7).

22. The method as claimed in claim 14, characterized in that an exhaust-gas temperature and an exhaust-gas mass flow and/or exhaust-gas volume flow is stored in a characteristic map for different operating states for each evaporator (10, 11), and in that, during the operation of the waste-heat utilization arrangement (1), the respective operating state of the waste-heat utilization arrangement (1) is determined, and the control unit (60) calculates a component of the actuation of the pump (6) and/or of the distributor valve block (7) in a manner dependent on said characteristic map and controls and regulates the pump (6) and/or the distributor valve block (7) in a manner dependent on said calculation.

23. The method as claimed in claim 1, wherein a collecting vessel (5) is arranged between the condenser (4) and the pump (6), and an inlet temperature ($T_{23}$) and an inlet pressure ($p_{23}$) of the working medium into the pump (6) are determined between the collecting vessel (5) and the pump (6), wherein, for different operating states of the waste-heat utilization arrangement (1), a cavitation threshold is stored in a characteristic map as a function of the inlet temperature ($T_{23}$) and the inlet pressure ($p_{23}$), and in that, during the operation of the waste-heat utilization arrangement (1), when the cavitation threshold is approached, the inlet temperature ($T_{23}$) and/or the inlet pressure ($p_{23}$) are regulated such that cavitation in the pump (6) is prevented.

24. The method as claimed in claim 1, wherein the optimized temperature difference ($\Delta T$) is less than 5 K.

* * * * *